US011145999B2

(12) United States Patent
Morita

(10) Patent No.: US 11,145,999 B2
(45) Date of Patent: Oct. 12, 2021

(54) ELECTRICAL CONNECTOR

(71) Applicant: YOKOWO CO., LTD., Tokyo (JP)

(72) Inventor: Nozomu Morita, Kita-ku (JP)

(73) Assignee: YOKOWO CO., LTD., Tokyo (JP)

( * ) Notice: Subject to any disclaimer, the term of this patent is extended or adjusted under 35 U.S.C. 154(b) by 0 days.

(21) Appl. No.: 16/473,637

(22) PCT Filed: Sep. 11, 2017

(86) PCT No.: PCT/JP2017/032639
§ 371 (c)(1),
(2) Date: Jun. 26, 2019

(87) PCT Pub. No.: WO2018/123151
PCT Pub. Date: Jul. 5, 2018

(65) Prior Publication Data

US 2019/0348773 A1 Nov. 14, 2019

(30) Foreign Application Priority Data

Dec. 26, 2016 (JP) ..... JP2016-251328

(51) Int. Cl.
*H01R 4/48* (2006.01)
*H01R 12/51* (2011.01)
(Continued)

(52) U.S. Cl.
CPC ..... *H01R 4/4836* (2013.01); *H01R 12/515* (2013.01); *H01R 12/53* (2013.01);
(Continued)

(58) Field of Classification Search
CPC .... H01R 4/4836; H01R 12/53; H01R 12/515; H01R 2101/00; H01R 13/025;
(Continued)

(56) References Cited

U.S. PATENT DOCUMENTS 3,945,711 A 3/1976 Hohorst et al.
6,347,031 B1 * 2/2002 Kawamoto ..... H01R 13/11 361/212

(Continued)

FOREIGN PATENT DOCUMENTS

CN 104466462 A 3/2015
CN 204885499 U 12/2015

(Continued)

OTHER PUBLICATIONS

International Search Report and Written Opinion dated Oct. 31, 2017 for PCT/JP2017/032639 filed on Sep. 11, 2017, 17 pages including English Translation of the International Search Report and Written Opinion.

(Continued)

*Primary Examiner* — Briggitte R. Hammond
(74) *Attorney, Agent, or Firm* — Xsensus LLP

(57) ABSTRACT

A connector for holding a linear conductor by a first contact portion and a second contact portion is provided. The linear conductor is inserted through an insertion portion. The first contact portion is formed in a pressing portion configured to be deformed elastically to press the linear conductor against the second contact portion. The second contact portion is formed in a fixed portion which is not deformed elastically and the second contact portion has at least one edge portion.

22 Claims, 9 Drawing Sheets

(51) Int. Cl.

| | |
|---|---|
| ***H01R 12/53*** | (2011.01) |
| ***H01R 13/02*** | (2006.01) |
| ***H01R 13/11*** | (2006.01) |
| ***H01R 13/14*** | (2006.01) |
| ***H01R 13/18*** | (2006.01) |
| ***H01R 13/24*** | (2006.01) |
| ***H01R 101/00*** | (2006.01) |

(52) U.S. Cl.
CPC ..... *H01R 13/025* (2013.01); *H01R 13/11* (2013.01); *H01R 13/14* (2013.01); *H01R 13/18* (2013.01); *H01R 13/24* (2013.01); *H01R 2101/00* (2013.01)

(58) Field of Classification Search
CPC ..... H01R 13/11; H01R 13/14; H01R 13/18; H01R 13/24; H01R 4/4818; H01R 12/57
See application file for complete search history.

(56) References Cited

U.S. PATENT DOCUMENTS

| | | | | |
|---|---|---|---|---|
| 8,579,651 | B2 * | 11/2013 | Hanning | H01R 4/4836 439/441 |
| 9,548,564 | B2 * | 1/2017 | Wu | H01R 24/20 |
| 9,876,286 | B2 * | 1/2018 | Urano | H01R 4/4836 |
| 10,193,244 | B2 * | 1/2019 | Aboulkassem | H01R 4/4845 |
| 2003/0194918 | A1 | 10/2003 | Fricke et al. | |
| 2008/0275179 | A1 | 11/2008 | Horton et al. | |
| 2015/0087193 | A1 * | 3/2015 | Takane | H01R 13/629 439/856 |
| 2016/0099528 | A1 * | 4/2016 | Lin | H01R 4/4836 439/638 |
| 2018/0062289 | A1 | 3/2018 | Stadler | |

FOREIGN PATENT DOCUMENTS

| | | | |
|---|---|---|---|
| DE | 3503370 | A1 | 8/1986 |
| DE | 202016104708 | U1 | 9/2016 |
| EP | 2 854 226 | A1 | 4/2015 |
| JP | S53-44239 | B2 | 11/1978 |
| JP | H07-192781 | A | 7/1995 |
| JP | 2000-182684 | A | 6/2000 |
| JP | 2012-079462 | A | 4/2012 |
| JP | 5604575 | B1 | 10/2014 |
| JP | 2015-115213 | A | 6/2015 |
| TW | M527173 | U | 8/2016 |
| WO | 2010/146525 | A1 | 12/2010 |

OTHER PUBLICATIONS

Chinese Office Action dated Apr. 2, 2020, issued in corresponding Chinese Patent Application No. 2017800805619, 13 pages, with English translation.
Extended European Search Report dated Jun. 25, 2020 in European Patent Application No. 17885864.3, 9 pages.
Office Action dated Dec. 8, 2020, in corresponding Japanese patent Application No. 2016-251328, 8 pages.

* cited by examiner

ELECTRICAL CONNECTOR

CROSS-REFERENCE TO RELATED APPLICATIONS

The present application is based on PCT filing PCT/JP2017/032639, filed Sep. 11, 2017, which claims priority to JP 2016-251328, filed Dec. 26, 2016, the entire contents of each are incorporated herein by reference.

TECHNICAL FIELD

The present invention relates to a connector for holding a linear conductor such as a conductor wire or a conductor pin inserted therein.

BACKGROUND ART

For example, connectors produced by processing a metal plate is used for electrically connecting a substrate and a cable to each other. A connector in the following Patent document 1 holds a linear conductor by a first contact portion which has a spring elasticity and a second contact portion which is cut and erected between them. A connector in the following Patent document 2 is configured to hold an electricity supply electric wire by a first spring portion and a second spring portion, and a tip portion of the second spring portion has an edge-shape.

PRIOR ART DOCUMENTS

Patent Documents

[Patent document 1] Japanese Patent No. 5,604,575
[Patent document 2] JP-A-2012-79462

SUMMARY OF THE INVENTION

Problems to be Solved by the Invention

Conventional connectors have a problem that the holding of a conductor wire is unstable because both contact portions that hold the conductor wire are elastic.

The present invention has been made in view of the above circumstances, and an object of the invention is therefore to provide a connector capable of improving a stability of holding a linear conductor.

Means for Solving the Problems

One aspect of the invention is a connector. This connector is a connector for holding a linear conductor by a first contact portion and a second contact portion, the linear conductor inserted through an insertion portion, wherein:

the first contact portion is formed in a pressing portion configured to be deformed elastically to press the linear conductor against the second contact portion; and the second contact portion is formed in a fixed portion which is not deformed elastically and the second contact portion has at least one edge portion.

The connector may include:

a front leg and a rear leg which are provided at a front position and a rear position in an insertion direction, respectively; and a connecting portion which connects the front leg and the rear leg to each other, wherein:

the second contact portion is provided in the connecting portion.

Another aspect of the invention is also a connector. This connector is a connector for holding a linear conductor inserted therein, including:

a front guide portion having an insertion portion;

a front leg and a rear leg which are provided at a front position and a rear position in an insertion direction, respectively;

a connecting portion which connects the front leg and the rear leg to each other and a pressing portion which presses the inserted linear conductor against the connecting portion, wherein:

the connecting portion has at least one edge portion; and the linear conductor is held by the pressing portion and the edge portion between the pressing portion and the edge portion.

The edge portion may include a lateral edge portion which extends so as to intersect with the insertion direction when viewed from a side of the pressing portion.

The connecting portion may branch into two portions at a front-rear halfway position in the insertion direction, and the lateral edge portion may be provided in a portion from which the two portions branch off.

The connecting portion may include a portion that is inclined so that the lateral edge portion is convex toward the pressing portion.

The edge portion may include a longitudinal edge portion which extends in the insertion direction when viewed from the side of the pressing portion.

The longitudinal edge portion may be curved so as to be convex toward the pressing portion.

The longitudinal edge portion may be respectively provided on both of left and right sides of the insertion direction when viewed from the side of the pressing portion.

The pressing portion may be a plate spring portion that is inclined with respect to the insertion direction so as to come closer to the edge portion as a position goes toward its tip, and a gradient of a tip portion of the pressing portion may be smaller than that of a base portion thereof.

The connector may be made of a sheet-metal part.

Desired combinations of constituent elements described above and a method, a system, etc. obtained by converting an expression of the invention are also effective as aspects of the invention.

Advantages of the Invention

The invention can provide a connector capable of improving a stability of holding a linear conductor.

EMBODIMENTS FOR CARRYING OUT THE INVENTION

Figure 1:
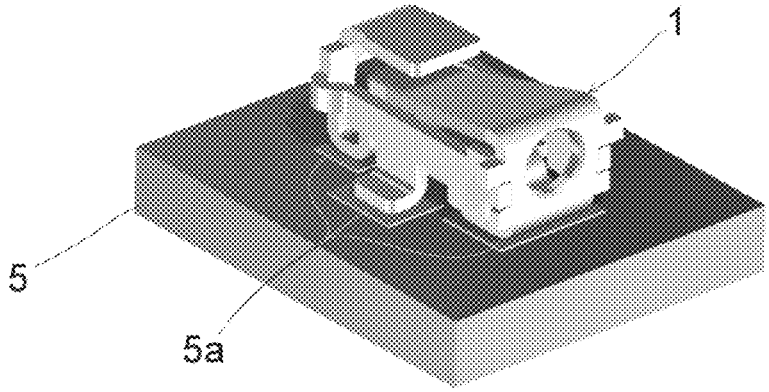
FIG. 1 is a perspective view showing a state that a connector 1 according to an embodiment of the present invention is mounted on a substrate 5.

A preferred embodiment of the present invention will be hereinafter described in detail with reference to the drawings. The same or equivalent constituent elements, members, etc. shown in the drawings are given the same symbol, and redundant descriptions will be omitted where appropriate. The embodiment is just an example and is not intended to restrict the invention. The features described in the invention and combinations of features are not necessarily essential to the invention.

Figure 2:
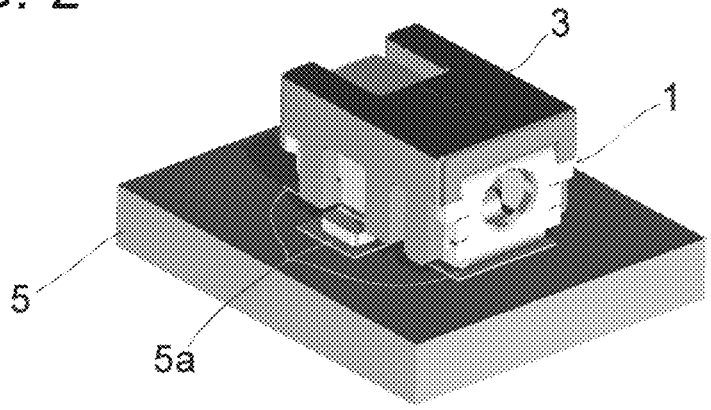
FIG. 2 is a perspective view showing a state that the connector 1 shown in FIG. 1 is covered with a cap 3.
Figure 3:
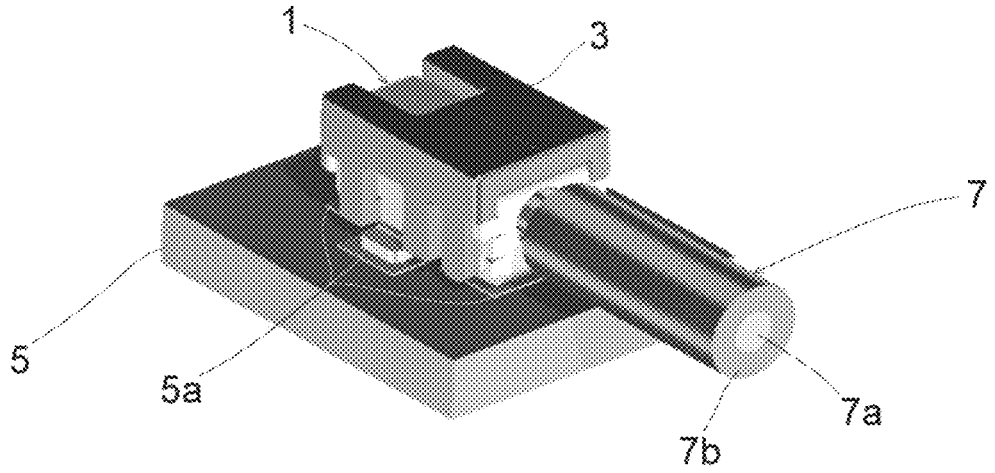
FIG. 3 is a perspective view showing a state that a cable 7 is inserted in and held by the connector 1 shown in FIG. 2.
Figure 4:
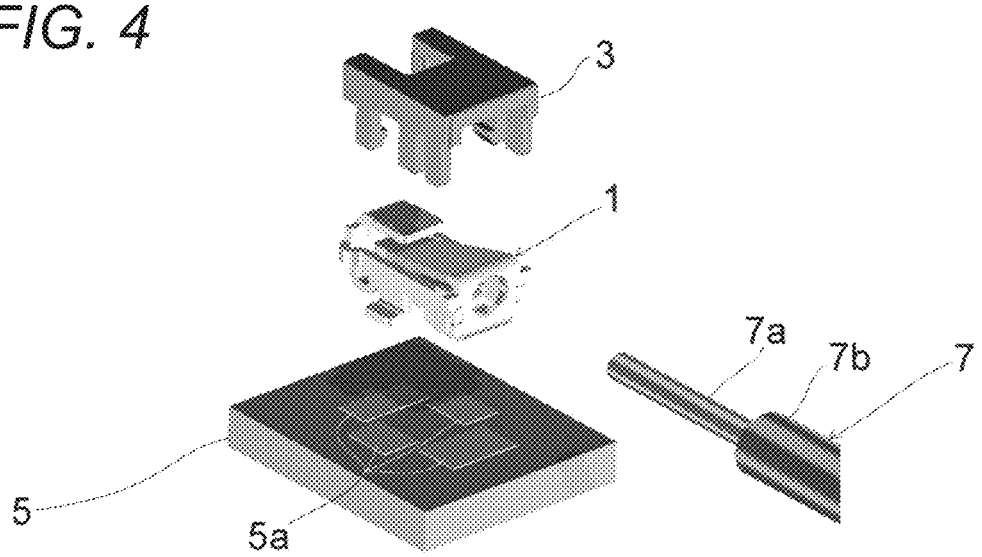
FIG. 4 is an exploded perspective view of FIG. 3.

A connector 1 according to the embodiment of the invention will be described with reference to FIGS. 1-18. As shown in FIG. 1, the connector 1 is placed on and electrically connected to electrodes 5*a* of the substrate 5 and mounted (fixed) on the substrate 5 by soldering or the like. For example, the substrate 5 is a COB (chip on board) substrate to be used for LED illumination or the like and the connector 1 is a lead socket for connecting a cable to the COB substrate. As shown in FIG. 2, when necessary, the connector 1 is covered with a cap 3 made of an insulating resin. As shown in FIG. 3, the connector 1 is configured to hold a cable 7 which is inserted therein, and can establish electrical connection between the substrate 5 and the cable 7. As shown in FIGS. 3 and 4, in the cable 7, a core wire (conductor wire) 7*a* that is a conductor (linear conductor) is covered with an insulating sheath 7*b*, and part of the insulating sheath 7*b* is removed at a portion of the cable 7 to be inserted into the connector 1. The core wire 7*a* may be a single wire or twisted wires. In the case of the twisted wires, it is preferable that at least a portion of the cable 7 where insulating sheath 7*b* is removed is coated with a conductive material so as not to come apart.

Figure 5:
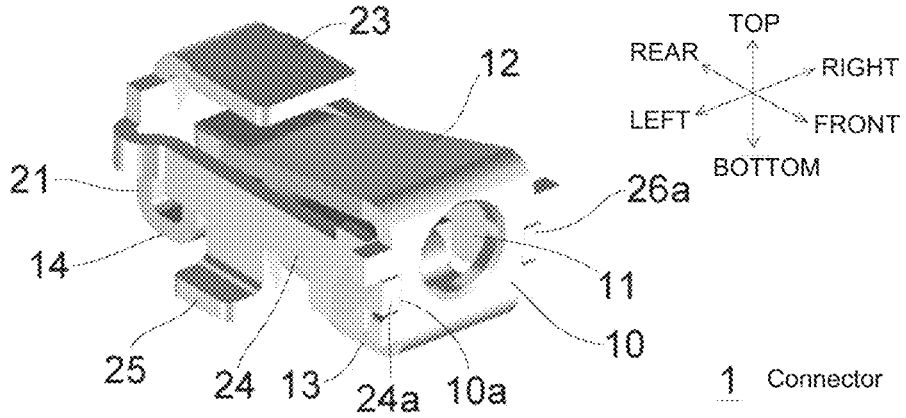
FIG. 5 is a perspective view of the connector 1 as viewed from the front side obliquely downward.
Figure 6:
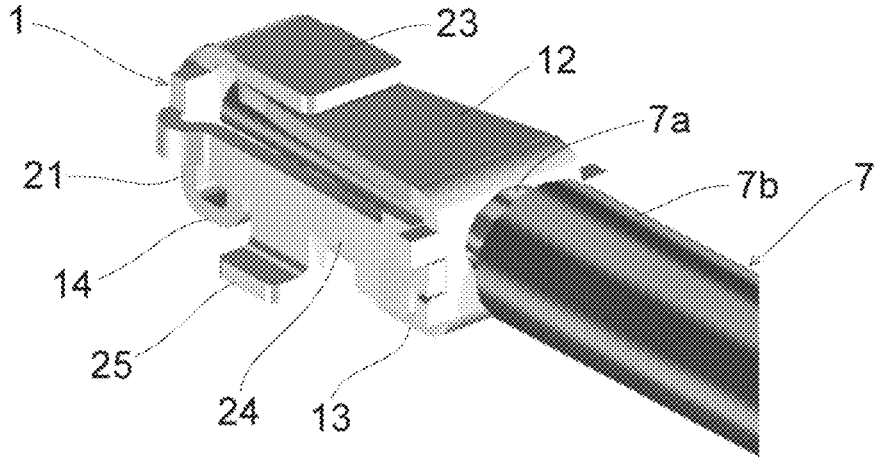
FIG. 6 is a perspective view showing a state that the cable 7 is inserted in and held by the connector 1 shown in FIG. 5.
Figure 8:
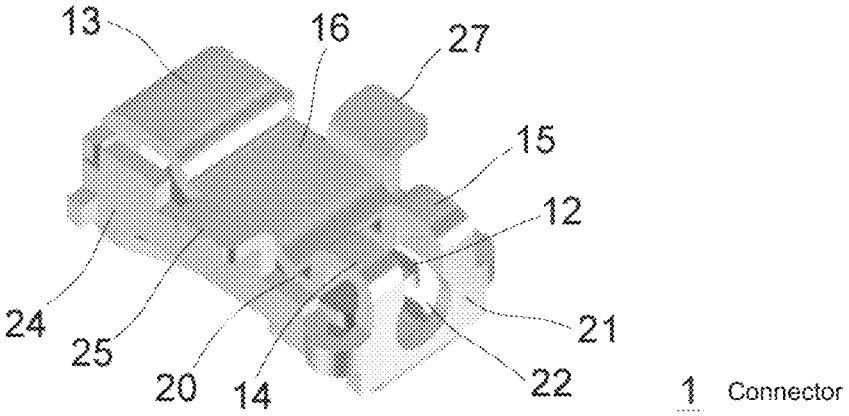
FIG. 8 is a perspective view of the connector 1 of the connector 1 as viewed from the rear side obliquely upward.
Figure 9:
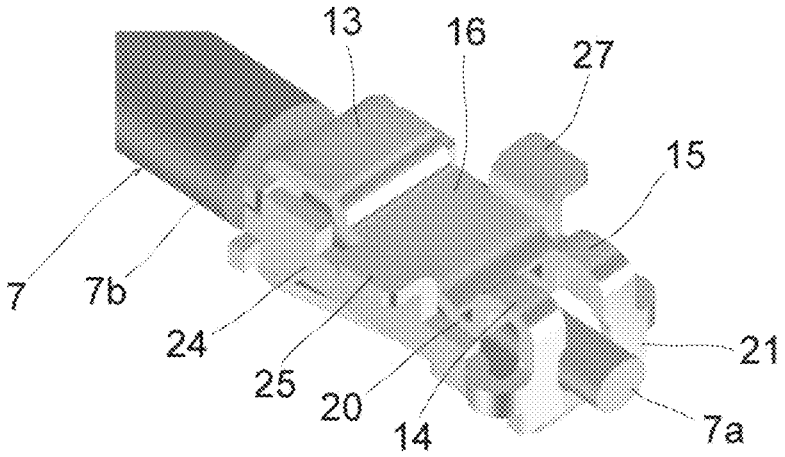
FIG. 9 is a perspective view showing a state that the cable 7 is inserted in and held by the connector 1 shown in FIG. 8.

As shown in FIGS. 5 and 8, the connector 1 is preferably a single-sheet metal part includes a front guide portion 10, a plate spring portion 12, a front leg 13, rear legs 14 and 15, a connecting portion 16, a rear guide portion 21, an absorption portion 23, a left frame portion 24, and a right frame portion 26. The front, rear, top, bottom, left, and right directions of the connector 1 are defined in FIG. 5.

Figure 17:
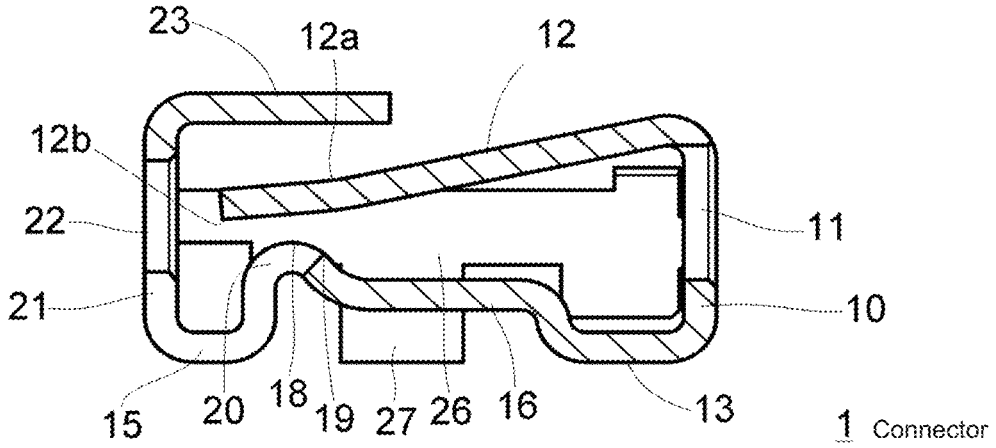
FIG. 17 is a left sectional view (a sectional view taken along line A-A in FIG. 14) of the connector 1.
Figure 18:
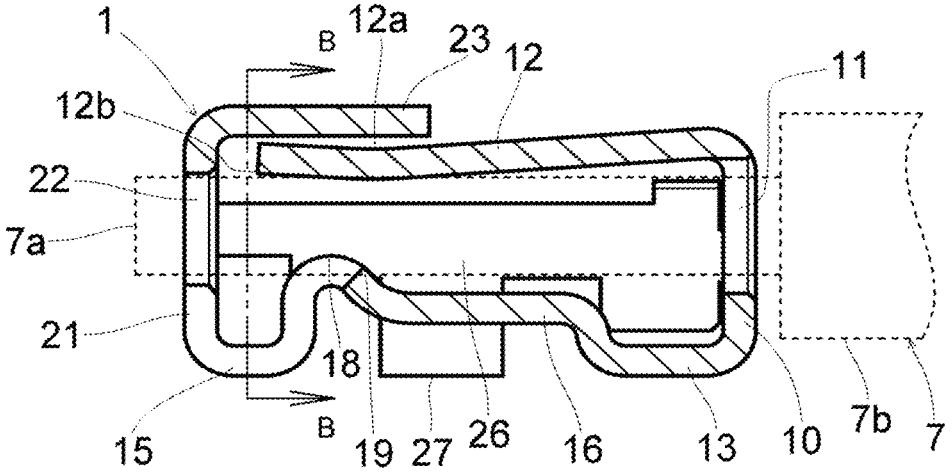
FIG. 18 is a sectional view showing a state that the cable 7 is inserted in and held by the connector 1 shown in FIG. 17.

The front guide portion 10 is a flat portion perpendicular to the front-rear direction, and has an insertion hole (insertion portion) 11 for the cable 7 at a center thereof. Although in the illustrated example the insertion hole 11 is a circular through-hole, it may be a non-circular through-hole or a cut in which a line connecting opening edges is not closed (not a closed loop). The plate spring portion 12 as a pressing portion is bent rearward from the top end of the front guide portion 10 and extends rearward in oblique lower direction. As shown in FIGS. 17 and 18, the plate spring portion 12 has a bending portion 12*a* where a gradient of the plate spring portion 12 is changed, the gradient at a rear portion of the bending portion 12*a* (i.e., a tip portion of the plate spring portion 12) is smaller than the gradient at a front portion of the bending portion 12*a* (i.e., a base portion of the plate spring portion 12). A bottom surface of a portion of the plate spring portion 12 around the bending portion 12*a* serves as a contact (a first contact portion) to come into contact with the core wire 7*a* of the cable 7 which is inserted through the insertion hole 11, and the contact is disposed so as to be opposed to longitudinal edge portions 17, 18 and a lateral edge portion 19 (described later). The front leg 13 is a flat portion perpendicular to the top-bottom direction, and is bent rearward from the bottom end of the front guide portion 10 and extends rearward in parallel to the front-rear direction. The bottom surface of the front leg 13 serves as a contact surface to come into contact with the electrode 5*a* of the substrate 5. The front leg 13 also serves as an attachment portion where the connector 1 is attached to the electrode 5*a* of the substrate 5 by soldering or the like.

The rear guide portion 21 is a flat portion perpendicular to the front-rear direction, and has, at a center thereof, an exit portion 22 through which the cable 7 is to be inserted. Although in the illustrated example the exit portion 22 is a cut in which a line connecting opening edges is not closed when viewed from the rear side, it may be a circular or non-circular through-hole. The absorption portion 23 is a flat portion perpendicular to the top-bottom direction, and is bent forward from the top end of the rear guide portion 21 and extends forward in parallel to the front-rear direction. The top surface of the absorption portion 23 serves as an absorption surface to be absorbed by an absorption head (not shown) when the connector 1 is mounted on the substrate 5 by a surface mounting machine. The rear legs 14, 15 are flat portions perpendicular to the top-bottom direction, and are bent forward from left portion and right portion of the bottom end of the rear guide portion 21 and extend forward in parallel to the front-rear direction, respectively. The bottom surfaces of the rear legs 14, 15 serve as surfaces to come into contact with respective electrodes 5*a* of the substrate 5. Furthermore, the rear legs 14, 15 serve as attachment portions where the connector 1 is attached to the electrodes 5*a* of the substrate 5 by soldering or the like.

Figure 7:
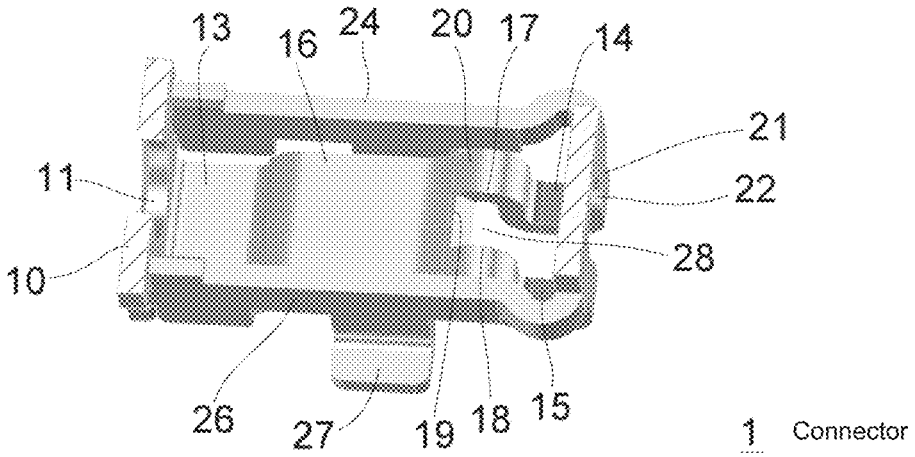
FIG. 7 is a perspective sectional view, as cut by a horizontal plane and viewed obliquely downward, of the connector 1.

The connecting portion 16 as a fixed portion connects the rear end portion of the front leg 13 to the front end portions of the rear legs 14, 15. Starting from the rear end portion of the front leg 13, the connecting portion 16 rises from the rear end portion of the front leg 13, extends rearward at a level that is higher than the front leg 13, is curved so as to be convex upward (a curved portion 20), extends downward, and reaches the front end portions of the rear legs 14, 15. As shown in FIG. 7, the connecting portion 16 has the curved portion 20 which is curved so as to be convex upward (toward the plate spring portion 12), and branches, in a front portion of the curved portion 20 (i.e., on the side of a middle position of the connecting portion 16 in the front-rear direction), into two portions to left and right sides to extend rearward.

Figure 10:
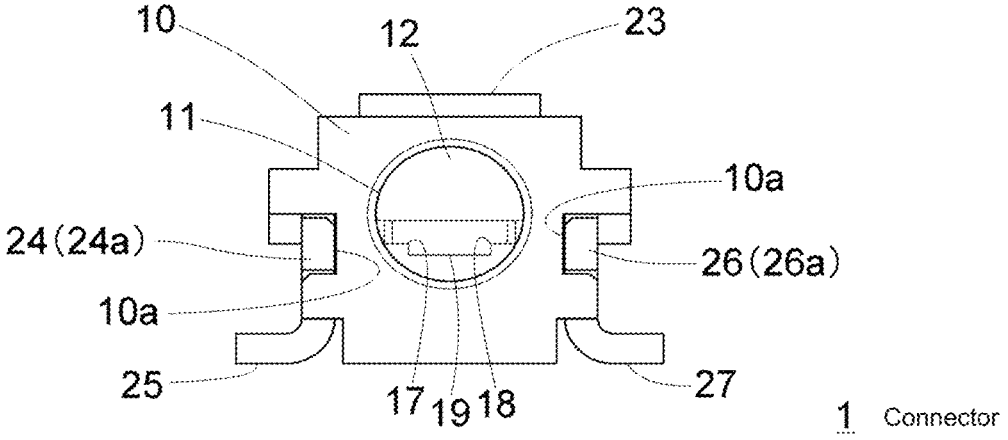
FIG. 10 is a front view of the connector 1.
Figure 11:
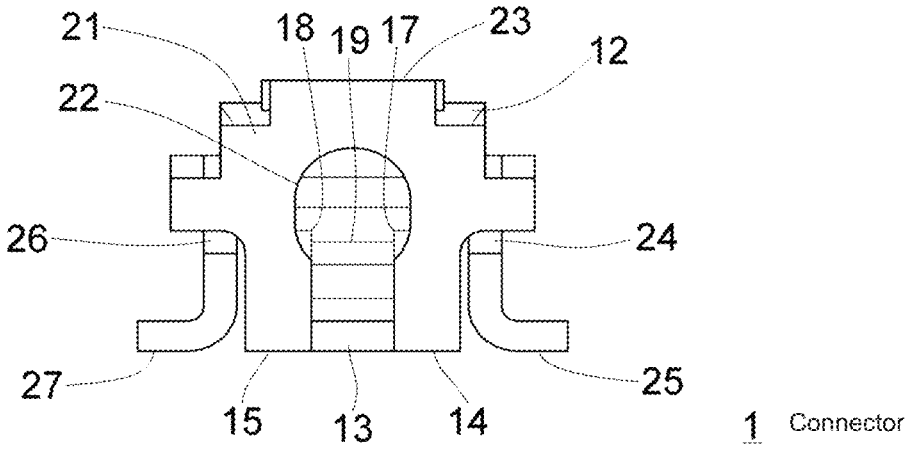
FIG. 11 is a rear view of the connector 1.

The connecting portion 16 has the longitudinal edge portions 17, 18 and the lateral edge portion 19. The longitudinal edge portions 17, 18 and the lateral edge portion 19 face a punched-out portion 28 (see FIG. 7) which was formed by punching-out for forming the branch of the connecting portion 16. The longitudinal edge portions 17, 18 extend parallel with each other in the front-rear direction with a prescribed interval formed between them in the left-right direction when viewed from above (from the side of the plate spring portion 12). The longitudinal edge portions 17, 18 are located in the curved portion 20 and are curved so as to be convex upward (toward the plate spring portion 12). The longitudinal edge portions 17, 18 are located at the same positions in the front-rear direction and the top-bottom direction and separated from each other in the left-right direction. As shown in FIG. 10, the height of the longitudinal edge portions 17, 18 and the interval between the longitudinal edge portion 17 and the longitudinal edge portion 18 are set so that they are located inside the circular insertion hole 11 when viewed from the side of the circular insertion hole 11 and that the outer circumferential surface of the core wire 7*a* of the cable 7 comes into contact with the longitudinal edge portions 17, 18 when the cable 7 is inserted through the insertion hole 11. In addition, where the core wire 7*a* is small in diameter, the height of the longitudinal edge portions 17, 18 and the interval between them may be set so that the outer circumferential surface of the core wire 7*a* comes into contact with only the lateral edge portion 18. The lateral edge portion 19 is formed at a branching portion of the connecting portion 16 from which the connecting portion 16 branches, extends in the left-right direction which is perpendicular to the front-rear direction in which the longitudinal edge portions 17, 18 extend, and is located in or in the vicinity of the curved portion 20 (i.e., in a portion that goes up toward the curved portion 20) so as to be convex upward. As shown in FIG. 10, the height and the width of the lateral edge portion 19 are set so that it is located inside the circular insertion hole 11 when viewed from the side of the circular insertion hole 11 and that the outer circumferential surface of the core wire 7*a* of the cable 7 comes into contact with the lateral edge portion 19 when the cable 7 is inserted through the insertion hole 11. The longitudinal edge portions 17, 18 and the lateral edge portion 19 serve as contacts (second contact portions) to come into contact with the core wire 7*a* of the cable 7.

The left frame portion 24 is a flat portion perpendicular to the left-right direction, is bent forward from the left end portion of the rear guide portion 21 (located on the left of the exit portion 22), and extends forward in parallel to the front-rear direction. A left leg 25 projects downward from a middle portion, in the front-rear direction, of the left frame portion 24. The left leg 25 is bent in L shape so that a bottom portion thereof extends leftward, and the bottom surface of the left leg 25 serves as a contact surface to come into contact with an electrode 5*a* of the substrate 5. The right frame portion 26 is a flat portion perpendicular to the left-right direction, is bent forward from the right end portion of the rear guide portion 21 (located on the right of the exit portion 22), and extends forward in parallel to the front-rear direction. A right leg 27 projects downward from a middle portion, in the front-rear direction, of the right frame portion 26. The right leg 27 is bent in L shape so that a bottom portion thereof extends rightward, and the bottom surface of the right leg 27 serves as a contact surface to come into contact with an electrode 5*a* of the substrate 5. Front end portions 24*a* and 26*a* of the left frame portion 24 and the right frame portion 26 are projection/recess-fitted with left and right recesses 10*a*, 10*a* of the front guide portion 10, respectively.

Figure 12:
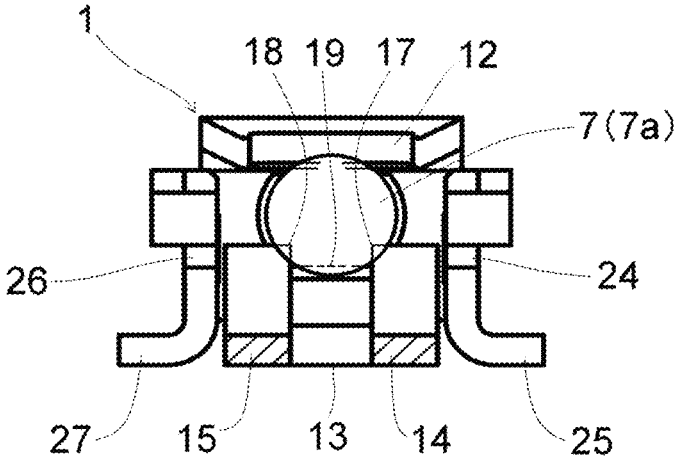
FIG. 12 is a rear sectional view (a sectional taken along line B-B in FIG. 18) of the connector 1.
Figure 13:
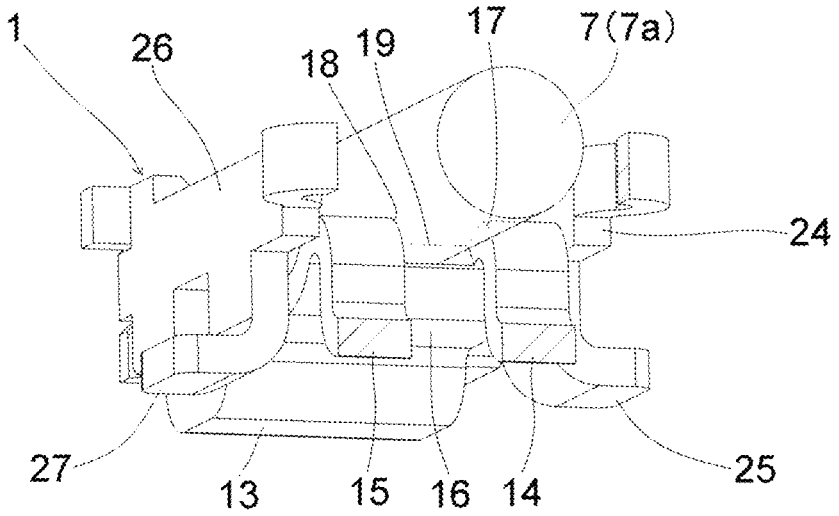
FIG. 13 is a rear perspective view of the connector 1 in which both sectional surfaces shown in FIG. 12 are commonly shown and a plate spring portion 12 and an absorption portion 23 are omitted.
Figure 14:
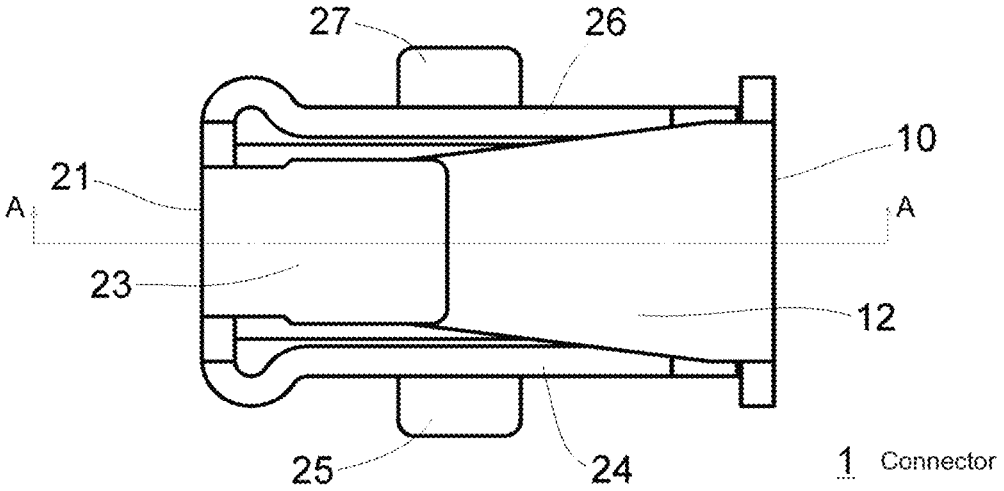
FIG. 14 is a plan view of the connector 1.
Figure 15:
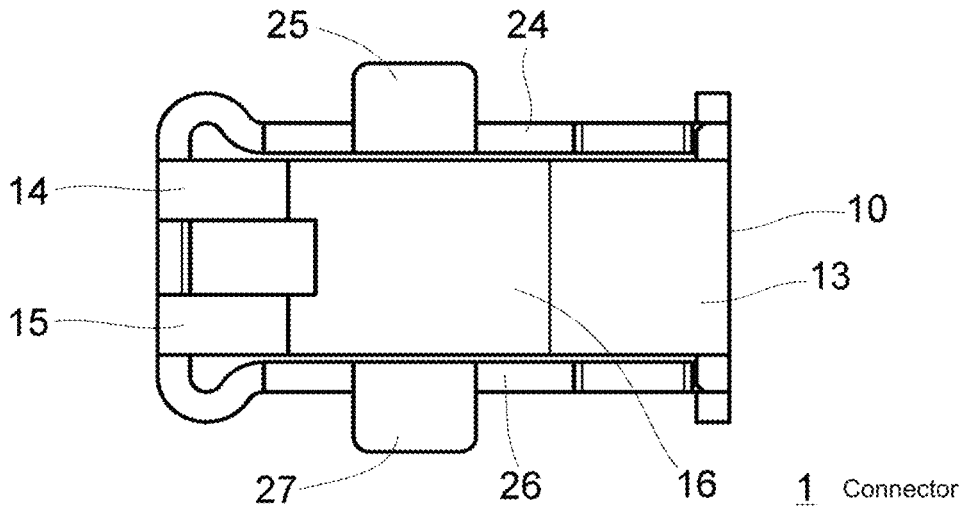
FIG. 15 is a bottom view of the connector 1.
Figure 16:
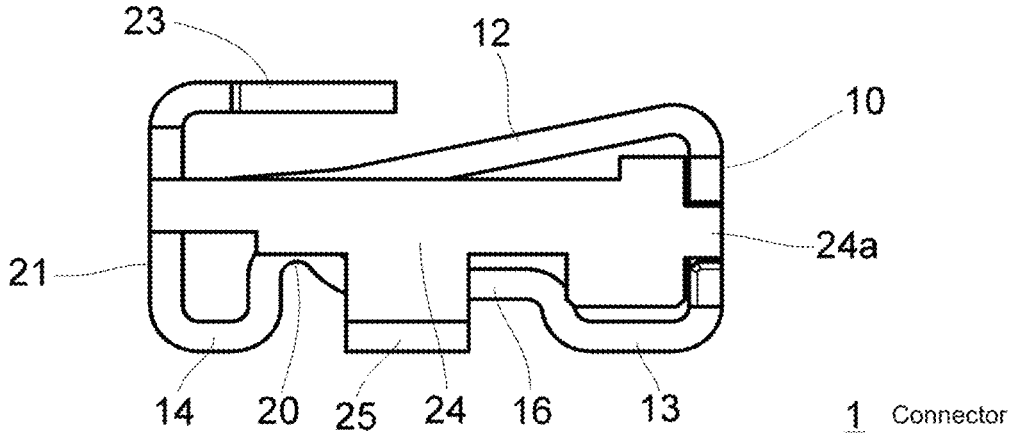
FIG. 16 is a left side view of the connector 1.

As seen from comparison between FIGS. 17 and 18, in a process of inserting the cable 7 into the connector 1, the core wire 7*a* of the cable 7 is inserted through the insertion hole 11 of the front guide portion 10 and goes rearward while pushing up the plate spring portion 12, and a tip portion of the core wire 7*a* goes out of the connector 1 past the exit portion 22. As shown in FIGS. 12 and 13, the center of the core wire 7*a* is located approximately at the middle between the longitudinal edge portion 17 and the longitudinal edge portion 18.

The core wire 7*a* of the cable 7 is urged downward (toward the connecting portion 16) by elastic force of the plate spring portion 12 and thereby pressed against the longitudinal edge portions 17, 18 and the lateral edge portion 19. That is, the core wire 7*a* is held between the plate spring portion 12 and the longitudinal edge portions 17, 18 and the lateral edge portion 19. The longitudinal edge portions 17, 18 and the lateral edge portion 19 bite into the outer circumferential surface of the core wire 7*a* and thereby generate holding force for preventing the core wire 7*a* from coming off. Where the outer diameter of the core wire 7*a* is smaller than or equal to a prescribed length, only the lateral edge portion 19 bites into the outer circumferential surface of the core wire 7*a* and thereby generates holding force. The connecting portion 16 is supported by the front leg 13 at its front end and by the rear legs 14, 15 at its rear end (both end support structure) to form a both end support structure. Thus, the longitudinal edge portions 17, 18 and the lateral edge portion 19 are less prone to be deformed elastically than in a case of a cantilever structure. As a result, the core wire 7*a* of the cable 7 can be held with higher stability than in the case of the conventional structure that a cable is held between two elastic contact portions. Although the embodiment employs the both end support structure as a structure with which the longitudinal edge portions 17, 18 and the lateral edge portion 19 are less prone to be deformed elastically, another structure may be employed such as a structure in which a member(s) forming edge portions is made thick to increase its stiffness or a structure in which a rib extending in the direction of elastic deformation (front-rear direction) is formed.

As shown in FIG. 17, since the gradient of the plate spring portion 12 is smaller in the rear of the bending portion 12*a*, as shown in FIG. 18 a rear-end edge portion 12*b* of the plate spring portion 12 does not bite into (engage with) the outer circumferential surface of the core wire 7*a* and, instead, the bottom surface of the bending portion 12*a* of the plate spring portion 12 touches the outer circumferential surface of the core wire 7*a*. As a result, the risk can be suppressed that when the cable 7 is pulled out of the connector 1, the rear-end edge portion 12*b* of the plate spring portion 12 is caught on the core wire 7*a* and the plate spring portion 12 is deformed excessively and thereby damaged.

The embodiment can provide the following advantages:

(1) By the configuration that the core wire 7*a* of the cable 7 is pressed against the longitudinal edge portions 17, 18 and the lateral edge portion 19 provided in the connecting portion 16 of the both end support structure by the urging force (elasticity) of the plate spring portion 12, the core wire 7*a* of the cable 7 can be held stably unlike in a case that the longitudinal edge portions 17, 18 and the lateral edge portion 19 are elastic.

(2) The cable 7 can be pulled out of the connector 1 merely by pulling the cable 1 by a force that is stronger than a prescribed force (one action). This is easy because no such manipulation as unlocking is necessary.

(3) Since the gradient of the rear end portion of the plate spring portion 12 is small so that the rear-end edge portion 12*b* does not bite into the core wire 7*a* of the cable 7, the risk can be lowered that when the cable 7 is pulled out of the connector 1, the rear-end edge portion 12*b* is caught on the core wire 7*a* and the plate spring portion 12 is thereby damaged. On the other hand, the longitudinal edge portions 17, 18 and the lateral edge portion 19 which bite into the core wire 7*a* are provided in the connecting portion 16 having the both end support structure, the risk that they are damaged is low even if force acts on them when the cable 7 is pulled out.

Although the invention has been described above using the embodiment as an example, it would be understood by those skilled in the art that various modifications are possible to each constituent element and a process employed in the embodiment within the confines of the claims. Modifications will be described below.

What is to be held by the connector 1 is not limited to a conductor wire and may be a conductor pin; linear conductors in general are objects to be held by the connector 1. The connector 1 may be mounted on a plate body that is not a substrate 5. A part of the substrate 5 may be made of a resin; for example, one of the two branch portions of the connecting portion 16 may be made of a resin.

DESCRIPTION OF SYMBOLS

1: Connector
3: Cap
5: Substrate
5*a*: Electrode
7: Cable
7*a*: Core wire (conductor wire)
7*b*: Insulating sheath
10: Front guide portion
11: Insertion hole (insertion portion)
12: Plate spring portion (pressing portion)
12*a*: Bending portion
13: Front leg
14, 15: Rear leg
16: Connecting portion
17, 18: Longitudinal edge portion (second edge portion)
19: Lateral edge portion (first edge portion)
20: Curved portion
21: Rear guide portion
22: Exit portion
23: Absorption portion
24: Left frame portion
25: Left leg
26: Right frame portion
27: Right leg
28: Punched-out portion

The invention claimed is:

1. An electrical connector comprising:
a first contact portion; and
a second contact portion,
wherein the electrical connector is configured to hold a linear conductor by the first contact portion and the second contact portion, when the linear conductor is inserted through an insertion portion of the electrical connector,
wherein the first contact portion is a surface formed in a pressing portion configured to be deformed elastically to press the linear conductor against the second contact portion, and the surface is not a distal edge of the pressing portion, and
wherein the second contact portion is formed in a fixed portion which is not deformed elastically and the second contact portion has at least one edge portion, the edge portion is formed at an edge of a punched-out region of the second contact portion.

2. The electrical connector according to claim 1, further comprising:
a front leg and a rear leg which are provided at a front position and a rear position in an insertion direction, respectively; and
a connecting portion which connects the front leg and the rear leg to each other, wherein:
the second contact portion is provided in the connecting portion.

3. An electrical connector for holding a linear conductor inserted therein, comprising:
a front guide portion including an insertion portion;
a front leg and a rear leg which are provided at a front position and a rear position in an insertion direction, respectively;
a connecting portion which connects the front leg and the rear leg to each other; and
a pressing portion which is configured to press the linear conductor against the connecting portion by a surface when the linear conductor is inserted into the electrical connector, wherein
the surface is not a distal edge of the pressing portion,
the connecting portion has at least one edge portion,
the edge portion includes a longitudinal edge portion, the edge portion is formed at an edge of a punched-out region of the connecting portion, and
the surface of the pressing portion and the edge portion are configured to hold the linear conductor between the surface of the pressing portion and the edge portion.

4. The electrical connector according to claim 2, wherein the edge portion includes a lateral edge portion which extends so as to intersect with the insertion direction when viewed from a side of the pressing portion.

5. The electrical connector according to claim 4, wherein
the connecting portion branches into two portions at a front-rear halfway position in the insertion direction, and
the lateral edge portion is provided in a portion from which the two portions branch off.

6. The electrical connector according to claim 4, wherein the connecting portion includes a portion that is inclined so that the lateral edge portion is convex toward the pressing portion.

7. The electrical connector according to claim 1, wherein the edge portion includes a longitudinal edge portion which extends in the insertion direction when viewed from a side of the pressing portion.

8. The electrical connector according to claim 7, wherein the longitudinal edge portion is curved so as to be convex toward the pressing portion.

9. The electrical connector according to claim 7, wherein the longitudinal edge portion is respectively provided on both of left side and right side of the insertion direction when viewed from the side of the pressing portion.

10. The electrical connector according to claim 1, wherein the pressing portion is a plate spring portion that is inclined with respect to the insertion direction so as to come closer to the edge portion as a position goes toward a tip portion of the pressing portion, and a gradient of the tip portion of the pressing portion is smaller than that of a base portion thereof.

11. The electrical connector according to claim 1, wherein the electrical connector is made of a sheet-metal part.

12. The electrical connector according to claim 3, wherein the edge portion includes a lateral edge portion which extends so as to intersect with the insertion direction when viewed from a side of the pressing portion.

13. The electrical connector according to claim 12, wherein the connecting portion branches into two portions at a front-rear halfway position in the insertion direction, and the lateral edge portion is provided in a portion from which the two portions branch off.

14. The electrical connector according to claim 12, wherein the connecting portion includes a portion that is inclined so that the lateral edge portion is convex toward the pressing portion.

15. The electrical connector according to claim 3, wherein the edge portion includes a longitudinal edge portion which extends in the insertion direction when viewed from a side of the pressing portion.

16. The electrical connector according to claim 15, wherein the longitudinal edge portion is curved so as to be convex toward the pressing portion.

17. The electrical connector according to claim 15, wherein the longitudinal edge portion is respectively provided on both of left side and right side of the insertion direction when viewed from the side of the pressing portion.

18. The electrical connector according to claim 3, wherein the pressing portion is a plate spring portion that is inclined with respect to the insertion direction so as to come closer to the edge portion as a position goes toward a tip portion of the pressing portion, and a gradient of the tip portion of the pressing portion is smaller than that of a base portion thereof.

19. The electrical connector according to claim 3, wherein the connector is made of a sheet-metal part.

20. The electrical connector according to claim 16, wherein the longitudinal edge portion is curved toward the pressing portion.

21. The electrical connector according to claim 3, further comprising:

the rear leg which serves as an attachment portion where the electrical connector is attached to an electrode of a substrate.

22. The electrical connector according to claim 2, wherein the edge portion is formed between two branches of a connecting portion which extend around the punched-out region.

* * * * *